United States Patent [19]

Spergel

[11] 4,440,163

[45] Apr. 3, 1984

[54] EMERGENCY ESCAPE BREATHING APPARATUS

[76] Inventor: Gabriel Spergel, 1806 Ditmas Ave., Brooklyn, N.Y. 11226

[21] Appl. No.: 403,713

[22] Filed: Jul. 30, 1982

[51] Int. Cl.[3] ..... A62B 7/02

[52] U.S. Cl. ..... 128/205.13; 128/206.24; 128/207.12; 128/205.17; 128/205.21; 128/205.22; 128/205.23; 128/205.25

[58] Field of Search ..... 128/201.23, 201.28, 128/205.21, 205.25, 206.12, 206.15, 206.21, 206.24, 206.28, 207.12, 205.22, 205.24, 205.13

[56] References Cited

U.S. PATENT DOCUMENTS

| | | | |
|---|---|---|---|
| 2,281,181 | 4/1942 | Clarke | 128/206.12 |
| 2,848,994 | 8/1958 | Aquado | 128/205.17 |
| 3,136,312 | 6/1964 | Gattone | 128/205.13 |
| 3,976,063 | 8/1976 | Henneman et al. | 128/205.21 |
| 4,296,746 | 10/1981 | Mason, Jr. et al. | 128/206.24 |

FOREIGN PATENT DOCUMENTS

| | | | |
|---|---|---|---|
| 107990 | 7/1917 | United Kingdom | 128/205.21 |

*Primary Examiner*—Henry J. Recla

*Attorney, Agent, or Firm*—Alexander Mencher

[57] ABSTRACT

An emergency escape breathing apparatus comprising a relatively rigid and transparent face mask attachable to the head of the wearer, a pressurized bottle supply of air or oxygen-enriched air adapted to be fed to said mask by a flow control assembly. Said assembly includes a rupturable diaphragm valve and a pressure-reducing reservoir, the valve at one end being connected to the mouth of the pressurized bottle, at the other end being connected to the reservoir inlet, a flexible hose at one end being connected to the face mask and at the other end being connected to the outlet of the reservoir. The assembly is adapted to provide conditions of pressure and gas content within the mask for respiratory requirements for predetermined brief periods of time to bridge the emergency interval. Accordingly, the face mask has a functioning exhalation valve and may also be provided with filters to eliminate inhalation of toxic elements in the ambient air and/or aid or substitute for said exhalation valve. The apparatus is of unitary structure, supportable and depending from the mask, capable of being folded into a compact unit and discardable after a single usage.

5 Claims, 4 Drawing Figures

EMERGENCY ESCAPE BREATHING APPARATUS

BACKGROUND OF INVENTION

1. Field of Invention

This invention relates to an emergency escape breathing apparatus particularly adapted for a single use and throw-away function and to provide a short term air supply to the wearer in a dangerous environment including a smoke-filled or burning building.

2. Brief Statement of the Prior Art

Heretofore, types of escape apparatus have been heavy, bulky, complicated in structure giving rise to difficulty in manipulation, application and making operational in times of emergency. Moreover, prior structures have been expensive to manufacture and subject to malfunction. This criticism of prior art includes typical structures shown in the following U.S. patents:

E. M. Spears et al., U.S. Pat. No. 3,043,302, July 10, 1962;

G. W. Oetjen et al., U.S. Pat. No. 4,019,507, Apr. 26, 1977;

Max L. Kranz, U.S. Pat. No. 4,221,216, Sept. 9, 1980.

BRIEF DESCRIPTION OF INVENTION

The invention comprises as one of the main components a relatively rigid, light-in-weight and transparent face mask structure easily attachable to the head of the wearer and serving as the sole support for and from which other parts of the apparatus freely hang to form a substantially short and straight-line suspension. Said parts include a flexible hose connecting the chamber formed between the mask and the wearer's face and a flow-control assembly for a pressurized bottle supply of air or oxygen-enriched and other types of air. The air is thus adapted to be fed in respirable condition to said mask chamber. The flow-control assembly is comprised of a light, stress-resisting and pressure-reducing chamber or reservoir for the pressurized bottle supply of gas and a suitable and conventional valve structure between and connecting said reducing chamber and bottle. The valve structure includes a rupturable seal or pressure-resisting disc element which normally closes the gas supply in the pressurized bottle and is further provided with an external valve element easily accessible and manipulable by the wearer to cause seal rupture for gas flow and continuous operational use of the apparatus. Under the invention the valve flow area is preferably variable in view of loss of pressure in the gas bottle during gas flow to the mask to enable the feeding of respirable gas to the mask chamber under acceptable conditions of pressure and content for a preset and predetermined time period. Because of the novel features and improvements in the apparatus and parts thereof as will hereinafter be described, the apparatus is discardable after a single use, and prior to use, the apparatus is capable of being folded and stored for accessibility.

BRIEF DESCRIPTION OF DRAWINGS

Accompanying this specification are drawings showing a preferred form of the invention wherein:

FIG. 2 is an enlarged elevational and fragmentary view of FIG. 1 along plane 2—2 thereof and showing substantially in block form the valve structure in sealing relationship with respect to the gas bottle and the pressure-reducing chamber or reservoir;

FIG. 3 is a view similar to FIG. 2 but showing the valve structure open and operational.

DESCRIPTION OF PREFERRED EMBODIMENT

Figure 1:
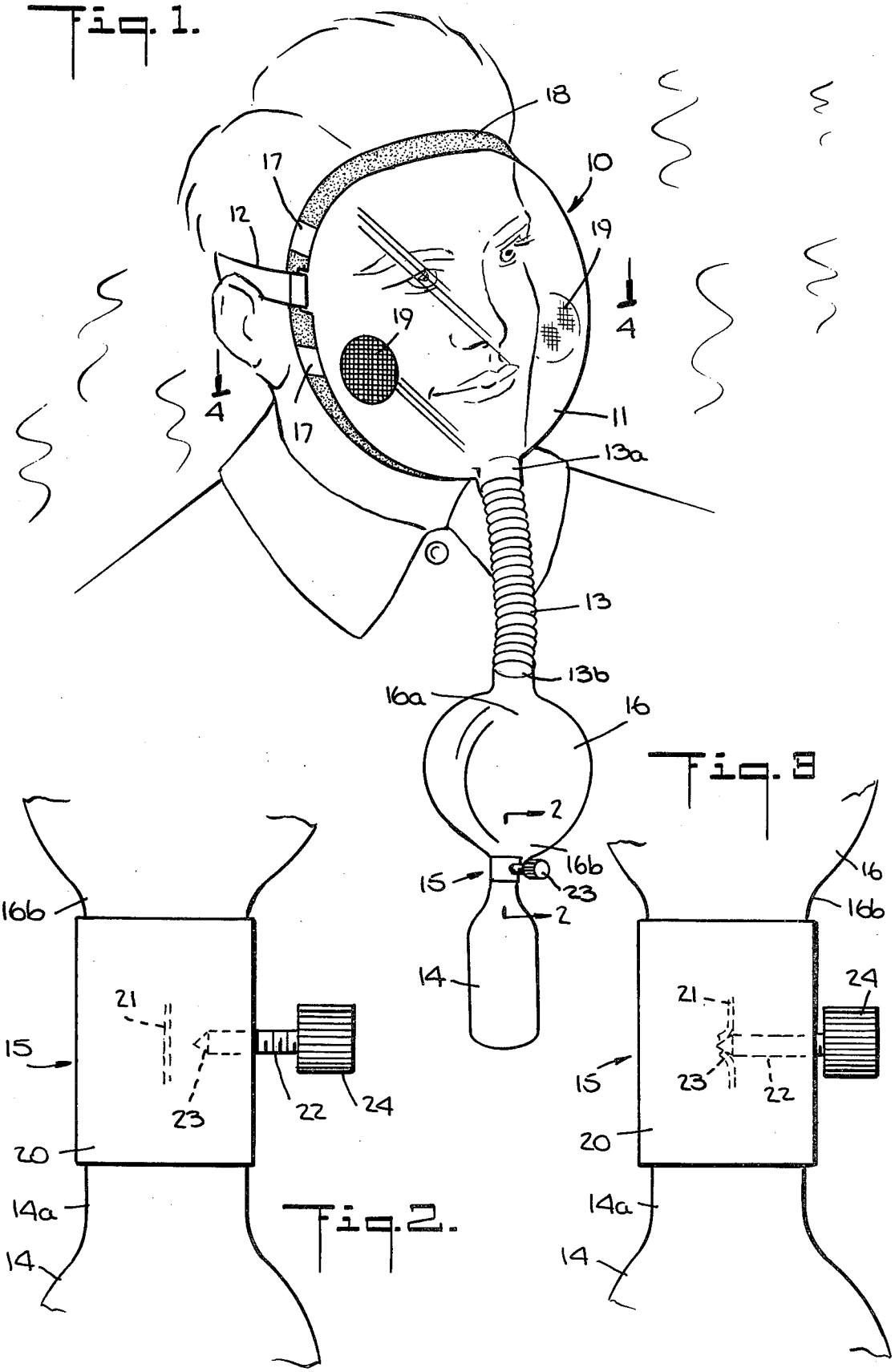
FIG. 1 is a view in perspective showing the apparatus of the invention secured to and depending from the head of a wearer.

In accordance with the invention and the preferred form shown in the drawings, FIG. 1 best illustrates the improved apparatus as a single and integrated unit supported and freely suspended from the head of the wearer and generally indicated by reference numeral 10. Thus, the unit is comprised of a novel and improved component in the form of a chamber-forming mask 11 having an adjustable attachment 12 for the head of the wearer, a flexible hose 13 for gas feed to the mask chamber, a pressurized bottle of gas 14 connected to a flow-control assembly comprising the valve structure 15 in association with a gas pressure-relieving or regulator chamber 16 for gas feed to hose 13 while the mask is in use. The disposition of the components of the integrated unit 10 as best seen in FIG. 1, namely, a substantially straight and short gas flow-path to mask 11, enables the wearer to go through two simple steps for application of the apparatus. First, the mask 11 is easily and conventionally attached to the head of the wearer for support and free suspension of the other components of the integrated unit. Then an external and accessible-by-feel valve fitting is manipulated for opening of the gas supply. Moreover, such disposition of the components of the integrated unit allows complete freedom of movement of both body and limbs in all postures and reduces the chances of malfunctioning of the apparatus due to accidental fouling or entanglements of and with parts of the apparatus.

Figure 4:
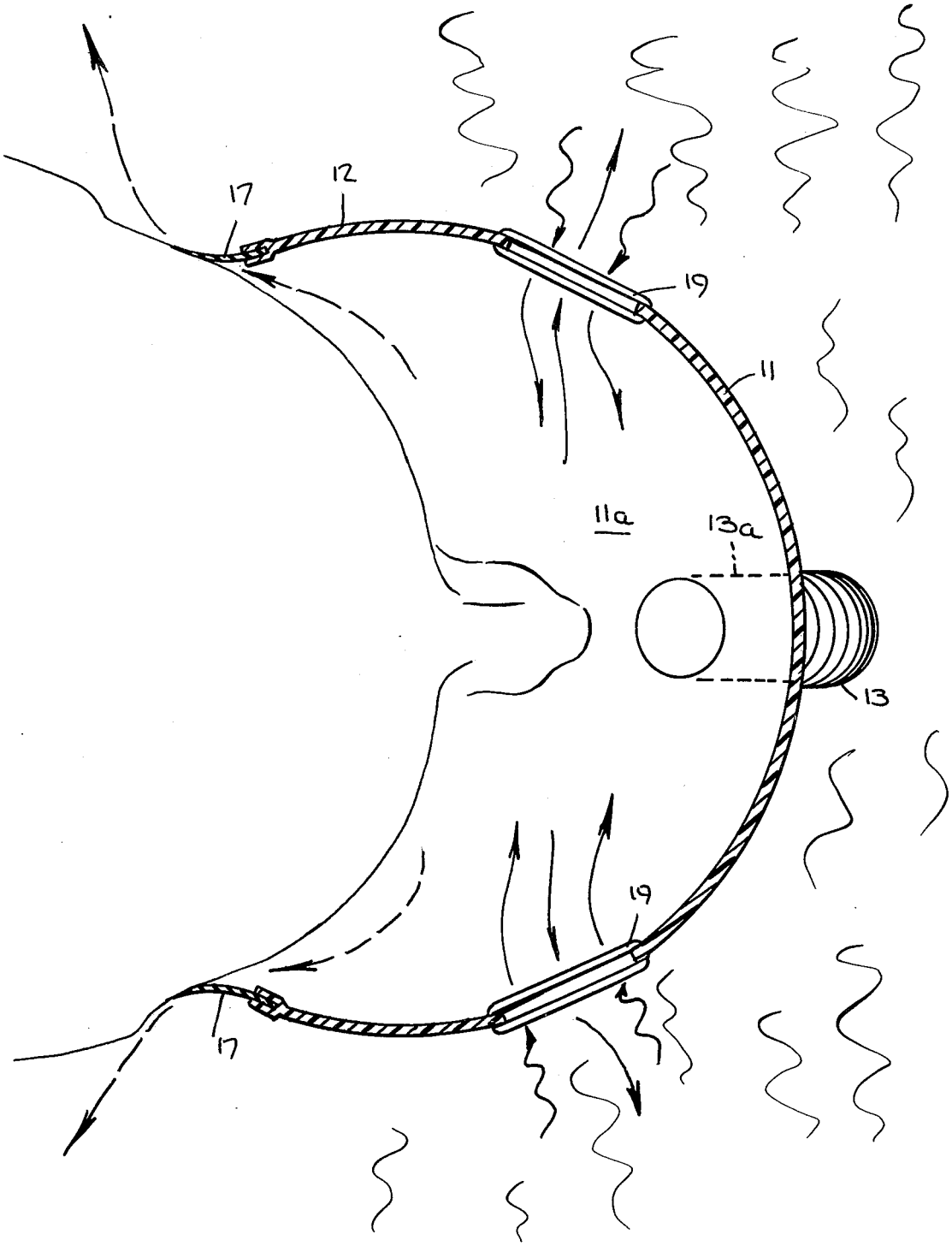
FIG. 4 is an enlarged sectional view of FIG. 1 across the plane 4—4 thereof showing functions of mask filters and flapper valves when the apparatus is operational.

Mask 11, adapted to form a breathing chamber **11*a* with the face of the wearer, is formed of a transparent and substantially rigid and inert plastic material as a preferred composition including the styrenes and acrylics, and capable of resisting the stress imposed thereon by the weight of the other components of the apparatus suspended from said mask. As best shown in FIGS. 1 and 4, mask 11 is provided with one or more conventional flapper or one-way valves 17 interposed along the face shape-conforming rim 18. Valves 17 function to exhaust to the ambient atmosphere the mixture of gas contents within chamber 11*a* due to gas feed and the wearer's exhalations thereby providing a substantially constant flow of breathable atmosphere over a predetermined time period such as from 3–7 minutes and preferably 5 minutes as will hereinafter be discussed. The mask rim 18 is preferably formed of any suitable elastomeric sealing material which is face shape-conforming and substantially nonflammable such as a synthetic sponge or the like. Mask 11 is further and optionally provided with one or more conventional and available filters 19 mounted in the face of the mask and adapted to eliminate inhalation of toxic elements in the ambient air, and/or aid or substitute for said exhalation valves 17** when the ambient atmosphere is depleted as through complete combustion of respiratory oxygen content.

Flexible hose 13 of suitable and substantially nonflammable material is suitably connected at the upper end **13*a* to the body of mask 11 preferably at the lower end of the mask vertical axis for communication with chamber 11***a*, while the lower end of said hose 13 as at 13*b* is suitably connected to the upper opening 16*a* of the pressure-reducing or regulator chamber 16 of the gas flow-control assembly for communication therewith. Hose 13 as shown is preferably ring-reinforced to prevent gas-flow cutoff if and when flexed, and is relatively short in length. Both of these considerations are hose features which minimize drop in gas-flow pressure therethrough when the apparatus is operational in the period of emergency.

The lower opening 16*b* of the regulator chamber is connected to and for communication with the outlet of valve structure 15 while the inlet of said valve structure is connected to and is adapted to communicate with the gas contents of bottle 14 at bottle mouth 14*a*. Bag or pressure-reducing chamber 16 is adapted to function so as to reduce gas pressure of and accumulate gas from pressurized bottle 14 for conveyance to mask chamber 11*a* through hose 13 while the mask is in use. Chamber 16 as shown is in the form of a pressure-resisting plastic container such as formed from a styrene or acrylic material and of a capacity to enable proper volumetric flow and pressure of gas from bottle 14. For the sake of safety and economy of production of the bottle component of the instant throw-away apparatus, said bottle as shown is preferably of a low pressure-rated aluminum or spun filament plastic container with an initial working pressure of about 1800 psi and of about a 20 cubic inch volumetric capacity to provide a supply of breathable oxygen for about a five minute period. For such bottle pressure and capacity, chamber 16 should preferably be of 15 inch volumetric capacity.

Gas supply valve structure 15 is necessarily of conventional and simplified type economical to manufacture and adapted to conform with feed requirements for mask chamber 11*a*. Said structure may be formed from a block of metal such as aluminum and the body suitably bored, drilled, recessed, tapped and equipped to afford functions for suitable and proper performance. And although progressive diminution of gas supply pressure within bottle 14 is compensated by the pressure-reducing or regulating chamber 16 leading to chamber 11*a* to maintain a pressure therewithin which is as safe and constant as possible, valve structure 15 in order to augment or serve said purpose may be provided with conventional or other structures for increasing the valve flow area. Said means add to the expense of valve production and are not shown and described herein.

Gas supply valve body 20 as shown substantially in diagrammatic form serves as a closure cap for bottle 14 and as a connector for the chamber 16, engagement of the valve body with mouth of bottle or container 14 and lower end of chamber 16 being conventional as by screw attachment or the like. A rupturable element such as a frangible disc 21 adapted normally to serve as the valve closure is disposed across an internal valve body bore connecting valve inlet and outlet channels, said bore and channels not being shown and described herein. Disc 21 is adapted to be pierced for gas flow through the valve structure as by an externally operated screw 22 adapted to puncture or eliminate disc 21 at the screw shank end 23 by finger manipulation of external screw knob 24. FIG. 3 shows disc 21 in process of being pierced or destroyed for valve opening.

Apparatus as above described is designed for throw-away purposes after a single use and to provide a constant flow of breathable atmosphere over a predetermined time period as hereinbefore stated from about 3 to about 7 minutes, preferably about 5 minutes. The gas supply source as above specified within a container of 20 cubic inch capacity and under an initial working pressure of about 1800 psi and with utilization of the chamber 16 having about a 15 cubic inch capacity will supply adequate air to maintain a breathable atmosphere for a wearer under normal or extended exertion for a 5 minute period. It is submitted that a pressurized steel container of higher psi internal pressure and of smaller cubic capacity if employed would require a more complex and expensive valve and pressure-regulator assembly and as described in prior art cited herein under U.S. Pat. No. 4,221,216.

As hereinbefore described, the apparatus functions by supplying and maintaining a breathable atmosphere within mask chamber 11*a*. A sufficient supply of air is available from gas bottle 14 to permit the wearer when rebreathing the air contained within the chamber 11*a*, to maintain a level of at least about 16–17% oxygen within said chamber over a period of 5 minutes. As air is introduced into chamber 11*a*, exhalation valves 17 in concert with filters 19 provides a constant exhausting of air from the chamber 11*a* thereby maintaining a constant, slightly super-atmospheric pressure within said chamber. When use of pressurized gas is unnecessary and the apparatus is used solely for filtering toxic elements out of oxygenated ambient atmosphere, valves 17 alone function as exhausts for mask chamber 11*a*.

As is typical in devices adapted to perform similar functions as in the instant apparatus, chamber 11*a* may be maintained at a pressure of from 0.018 to about 0.036 psi above the surrounding atmosphere. Thus, gas supply valve structure 15 is designed to provide in conjunction with chamber 16 a conventional fow rate of about 10 liters per minute, and which has been deemed sufficient to equal the consumption of oxygen at a moderate exertion level such as ascending stairs or inclines of about 1.6 liters per minute.

Pressurized gas bottle 14 is adapted to contain a suitable source of breathable atmosphere and may comprise air or oxygen-enriched air having an elemental oxygen content less than about 28% so as to be under oxygen levels which could readily ignite combustible materials. Or, in some applications it may be desirable to extend the usable period of the apparatus by providing a breathable atmosphere containing higher elemental oxygen contents. Thus, the invention contemplates the use of pure oxygen or oxygen content within the bottle 14 at any level from 20.9 to 100%.

The preferred form of the invention as above described has been designed for functionality over a predetermined time period as heretofore specified in emergency situations, for economy in cost of production to sustain its throw-away characteristics after a single use, for its simple, convenient and easy application and safe use as by merely applying the mask 11 to the head of the wearer and puncturing the valve closure element 21 by screw 22. A further feature of the invention resides in the easy folding of the apparatus, easy accessibility and exposure in a room as on a wall or shelf and simple definition of directions for applying and activating the apparatus.

It is understood that minor changes and variations in the materials, assembly, integration, size, location of parts and pressures of gas utilized may all be resorted to without departing from the spirit of the invention and the scope of the appended claims.

I claim:

1. In an emergency escape and throw-away breathing apparatus adapted to be supported by and freely depend from the head of the wearer, the improvement comprising in combination:

(a) a convexly-curved mask having head band means for attachment around the head of the wearer and of relatively rigid and transparent plastic to form a sealed chamber with the face of the wearer and being adapted to receive a breathable atmosphere containing elemental oxygen and having pressure-relieving valve means in the mask communicating with the ambient atmosphere;

(b) a breathable atmospheric source comprising a pressurized container of an elemental oxygen-containing gas;

(c) a gas flow control assembly connected thereto and in axial alignment therewith and including a pressure-reducing, stress-resisting and regulating gas reservoir bag having an inlet at the lower axial end and an outlet at the axial top, and further including a valve structure at the lower axial end affixed to and normally closing gas flow from the mouth of said pressurized container and at the upper axial end affixed and for gas flow to the inlet of said reservoir bag so as with said container to present a fixed, permanently open and straight gas flow path, said valve structure including rupturable valve closure means therewithin and external and visible finger-accessible and finger-engagable operating means intermediate the gas container and said reservoir bag and adapted to serve as the operative element for rupture of said valve closure means for valve opening and gas feed to said inlet of the reservoir bag; and (d) a flexible and kink-proof hose section connecting said face mask adjacent the lower axial end thereof to said reservoir bag at the outlet thereof and adapted to feed gas into the said gas mask chamber, said kink-proof hose section serving to act as a yieldable folding area when the apparatus is in inoperative and folded and stored position whereby the gas flow-path retains its open and unrestricted condition, said kink-proof hose section further serving to act when the apparatus is operational so as to render the gas flow path yieldable to override ensnaring obstacles during wear and also to contribute to the unidirectional and substantially straight-line gas flow-path to the mask and to the substantially incompressible structure of said flow path.

2. In apparatus of claim 1 wherein said mask at least on one lateral side thereof has filtering means for toxic elements penetrating the body of said mask to supplement or substitute for said pressure-relieving valve means therein when malfunctioning.

3. In apparatus of claim 1 wherein said flexible hose is relatively short to impart a short gas flow-path of the apparatus below the mask to avoid ground fouling or dragging thereof when the wearer is in stooping, knee or crouching, moving or stationary position, and wherein said mask has filtering means for toxic elements penetrating the body of said mask to supplement or substitute for said pressure-relieving valve means therein.

4. In apparatus of claim 3 wherein the gas container is of about 20 cubic inch capacity and is adapted to be under an initial working pressure of about 1800 psi and wherein said reservoir bag is of about 15 cubic inch capacity.

5. In apparatus of claim 1 wherein said pressure-relieving valve means comprises at least one one-way valve along the mask edge of said sealed chamber and wherein said mask has filtering means at least on one side thereof to supplement or substitute for said pressure-relieving valve means therein when malfunctioning wherein the wearer is given unobstructed vision through said mask.

* * * * *